US005833187A

United States Patent [19]

Williamson

[11] Patent Number: 5,833,187

[45] Date of Patent: Nov. 10, 1998

[54] RETAINING DEVICE

[76] Inventor: Theodore A. Williamson, 527 E. Kingston Ave., Charlotte, N.C. 28203

[21] Appl. No.: 754,227

[22] Filed: Nov. 20, 1996

[51] Int. Cl.[6] ..... A47B 96/06

[52] U.S. Cl. ..... 248/221.11; 248/222.51; 248/309.1; 248/489; 411/345

[58] Field of Search ..... 248/221.11, 222.51, 248/224.8, 493, 489, 231.9, 309.1; 411/345, 340, 341, 342, 344

[56] References Cited

U.S. PATENT DOCUMENTS

| | | | |
|---|---|---|---|
| 450,127 | 4/1891 | Wrigley | 411/340 |
| 1,696,467 | 12/1928 | Allen | 411/340 X |
| 3,020,013 | 2/1962 | Ochin et al. | 248/493 X |
| 3,476,007 | 11/1969 | Collister | 411/345 |
| 3,612,458 | 10/1971 | Mwanyoha | 248/493 X |
| 3,966,157 | 6/1976 | Corral et al. | 248/493 X |
| 4,953,817 | 9/1990 | Mosteller | 248/222.51 |

FOREIGN PATENT DOCUMENTS

| | | | |
|---|---|---|---|
| 91256 | 9/1961 | Denmark | 411/345 |

*Primary Examiner*—Leslie A. Braun
*Assistant Examiner*—Derek J. Berger
*Attorney, Agent, or Firm*—Kennedy Covington Lobdell & Hickman, LLP

[57] ABSTRACT

A device for retaining two individual members in an adjacent condition includes a support base with an arrangement for attaching the support base to a first of the two individual members, a latching arm pivotally mounted to the support base, a biasing member attached to a distal end of the latching arm for causing the latching arm to pivot downwardly under gravity's influence with a portion of the latching arm extending upwardly beyond an upper surface of the base and a receiver having an arrangement for attaching the receiver to a second of the individual members and a receiving member extending from the attachment arrangement in a manner for at least partially surrounding the latching arm with the receiving member defining an opening through which the biasing member may be passed for placing the two individual members in an adjacent relation.

21 Claims, 4 Drawing Sheets

RETAINING DEVICE

BACKGROUND OF THE INVENTION

The present invention relates broadly to apparatus and devices for retaining two individual members in an adjacent condition and, more specifically, to such a device which incorporates a gravity actuated latching arm acting in cooperation with a receiver to retain two individual members in an adjacent latched condition.

Generally, two individual members such as drawers and their associated frames, and doors along with their associated jambs, may be retained in a closed or adjacent condition by using a hasp attached to one member and an associated staple attached to another member with the hasp held in place over the staple by a pin, padlock, bolt, wire or other such member.

Other members that are retained in an adjoining state including tarpaulins which have grommets disposed around the edges thereof which are held in place by rope, hooks or, in the case of boats and automobiles, snap fasteners. Additionally, picture hangers which are formed as hooks and are held in place by a nail or adhesive may also be considered items which hold two individual members in an adjacent condition.

The above-described hardware is not without fault. The aforesaid hasp and staple system can be clumsy to operate and requires a third, free element to retain the two individual members in an adjacent, latched condition. The aforesaid grommeted tarpaulins also are not without fault in that another free element is usually required to effect the retention of the tarpaulin in an adjacent condition with another member. Further, snap fasteners typically provided for use with automotive or marine tarpaulins are difficult to operate and may be difficult to remove once exposed to moisture, as is common in a marine environment.

Finally, picture hangers do not provide any sort of positive hold on a wire used to support a picture suspended therefrom. Therefore, the picture is subject to disruption, dislodgement and other movement which is not prevented by the hanger. The hanger only keeps the picture from falling.

There accordingly exists a need for a device to positively retain two individual members in an adjacent condition.

SUMMARY OF THE INVENTION

It is accordingly an object of the present invention to provide a singular device which will retain two members in an adjacent condition.

It is further an object of the present invention to provide such a device which will act to retain a door against a door jamb or a drawer against its frame.

It is another object of the present invention to provide such a device which will act to retain a tarpaulin or other grommeted flexible member in an adjacent condition with a support structure.

In is yet another object of the present invention to provide such a device which will act as a picture hanger to retain a picture against a wall member.

To that end, a device for retaining two individual members in an adjacent condition includes a support base for attaching the support base to a first of the two individual members; a latching arm pivotally mounted to the support base; a biasing member attached to a distal end of the latching arm for causing the latching arm to pivot downwardly under gravity's influence with a portion of the latching arm extending upwardly beyond an upper surface of the support base; and a receiver having an arrangement for attaching the receiver to a second of the individual members and a receiving member extending from the attachment arrangement in a manner for at least partially surrounding the latching arm with the receiving member defining an opening through which the biasing member may be passed for placing the two individual members in an adjacent relation by passing the biasing member and the latching arm through the opening, with the receiving member in at least partially surrounding relation with the support base to the extent that a pivot point associated with the latching arm and the support base is passed through the opening with the biasing member being influenced by gravity to drop and move the latching arm into a vertically extending disposition with the latching arm acting to abut the receiver to retain the two individual members in an adjacent relationship.

It is preferred that the biasing member and the receiving member be formed with complementary geometric configurations for passage of the biasing member through the receiver-defined opening. Further, it is preferred that the biasing member be formed as a sphere and that the receiving member be formed as a ring.

It is additionally preferred that the arrangement for attaching the receiver to a second of the individual members include a threaded shank projecting away from the receiving member with the shank being configured for threaded engagement with the second of the two individual members.

It is further preferred that the latching arm be formed with a taper extending along a surface of the latching arm facing the receiver when the device is in a latched condition for enhancing ease of latching arm movement should the latching arm abut the receiver when moving the latching arm to a generally horizontal position for unlatching.

Preferably, the arrangement for attaching the support base to the first of the two individual members includes a threaded member projecting outwardly from the support base for mounting engagement with the first of the two individual members for retaining the first of the two individual members in engagement with the support base for utilization of the device to retain the two individual members in an adjacent condition.

It is further preferred that the support base be formed as a generally cylindrical member having a slot formed therein for receipt of the latching arm with the latching arm being pivotally mounted to the support base in the slot. Preferably, the latching arm is retained in a pivotally mobile relationship with the support base by a pin extending through walls forming the support base and through the latching arm to define a pivot location for the latching arm. Further, the support base may include a shoulder projecting into the slot for abutment of the latching arm thereagainst when the latching arm is extended outwardly from the support base in a generally horizontal manner.

The receiver may be formed as a wire and the latching arm may be formed with a groove therein with the groove being formed on that portion of the latching arm in facing relation with one of the two individual members with the groove being for purchase of the wire.

By the above, the present invention provides a unique, simple device for retaining two individual members in an adjacent condition. The device is capable of many uses yet those skilled in the art will appreciate that the primary uses are for latching doors or drawers in an adjacent condition with their respective support members, as a retaining member for grommeted tarpaulins, tents or other flexible grommeted members and as a picture hanger.

DETAILED DESCRIPTION OF THE PREFERRED EMBODIMENT

Figure 1:
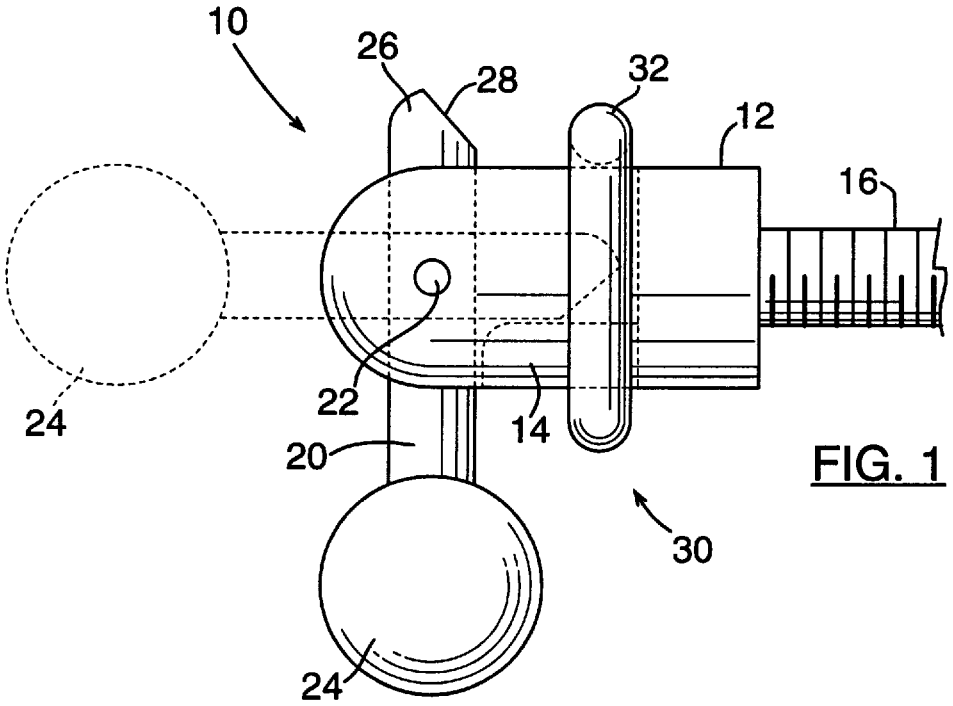
FIG. 1 is a side view of a device for retaining two individual members in an adjacent condition according to the preferred embodiment thereof.
Figure 2:
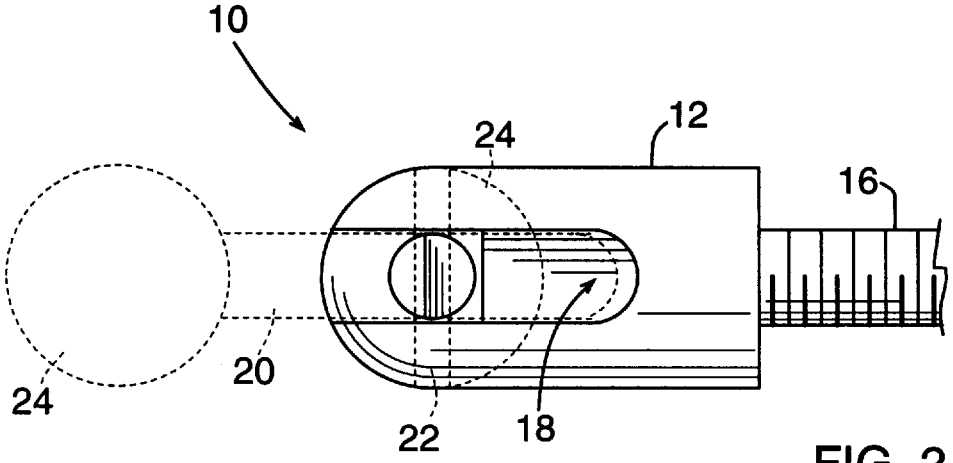
FIG. 2 is a top plan view of the device illustrated in FIG. 1.
Figure 3:
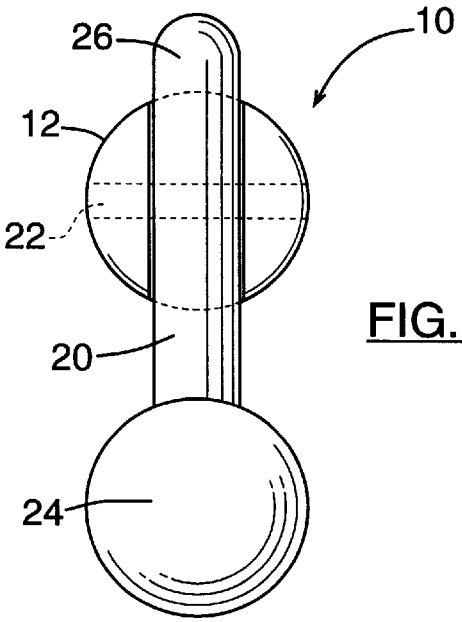
FIG. 3 is a front view of the device illustrated in FIG. 1.

Turning now to the drawings and, more particularly, to FIG. 1, a device for retaining two individual members in an adjacent condition is illustrated generally at 10 and includes a support base 12 formed as a generally cylindrical member, rounded at one end, and having a slot 18 formed therein as seen in FIG. 2. The slot 18 extends from an open, curved end to a terminal position within the cylindrical body. A shoulder 14 is formed within the slot 18 integrally with the support base 12 at a position adjacent an outer edge of the slot 18. A threaded shank 16 extends outwardly from a flat surface of the support base 12. While the threaded shank 16 is illustrated as a preferred mounting arrangement for the retaining device 10 of the present invention, it will be appreciated by those skilled in the art that the particular arrangement chosen for mounting the support base 12 to one of the two individual members is dependent upon the material forming the individual member to be retained.

A latching arm 20 is formed as a generally cylindrical rod-like member and is pivotally mounted to the support base 12 within the slot 18 using a pin 22 which extends through the support base 12 and through the latching arm 20 to retain the latching arm 20 in a pivotally mobile condition. The latching arm 20 is mounted to the support base 12 with the pin 22 disposed closely adjacent the shoulder 14 such that upon movement of the latching arm 20 to a generally horizontal position, the latching arm 20 will abut the shoulder 14 as seen in FIG. 1 in broken lines. As will be seen in greater detail hereinafter, the general, relative dimensions of the latching arm 20 are important with respect to operation of the device 10. As seen in FIG. 1, when the latching arm 20 is in a vertically oriented disposition, i.e., a latched condition, an extended portion 26 projects upwardly beyond the support base 12. This extended portion 26 acts as an abutment member for a portion of the receiver 30 which will be seen in greater detail hereinafter. In that regard, the upper portion 26 of the latching arm 20 is formed with a tapered surface 28, the use and importance of which will also be seen in greater detail hereinafter.

In order for the device to provide sure and positive operation, a biasing member 24 is mounted to the latching arm 20 at the end opposite that of the extended portion 26. As seen throughout the figures, the biasing member 24 is formed as a sphere. As may be imagined, its function is to bias the latching arm under gravity's influence into a vertically oriented, latched state. A secondary function is to provide a hand hold for anyone seeking to disassociate the two members retained in an adjacent condition by the device 10 of the present invention. As seen throughout the figures, the biasing member 24 is formed as a sphere.

Figure 4:
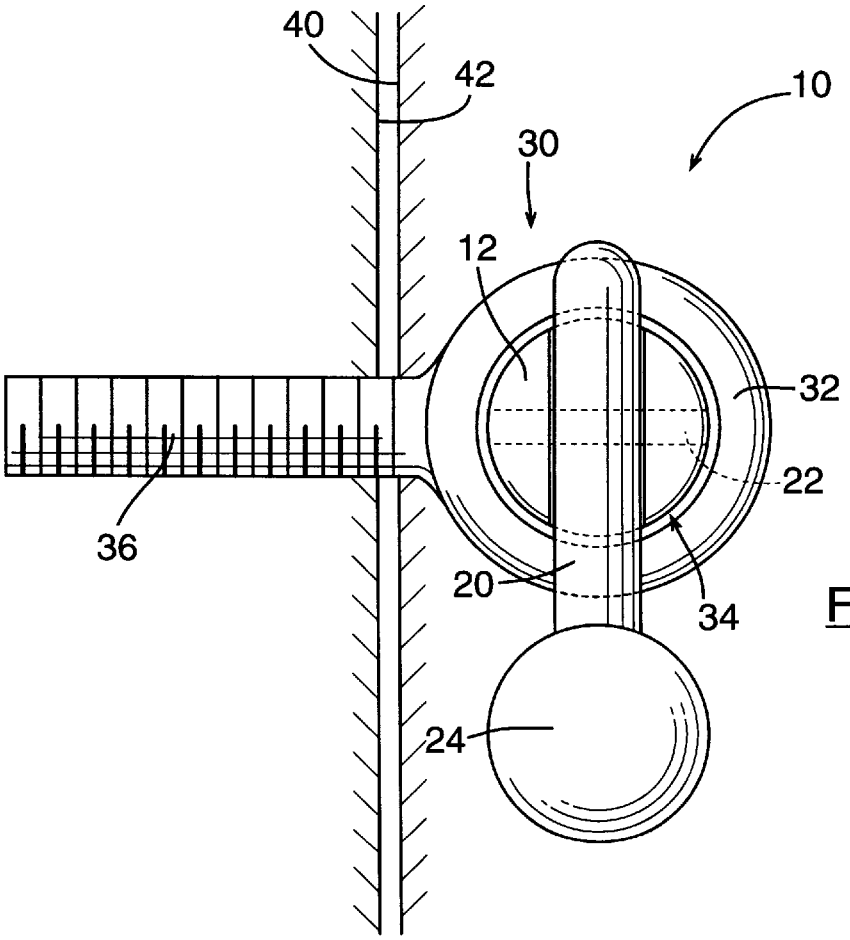
FIG. 4 is a front view of the device including a receiver illustrating two individual members retained in an adjacent condition by the device.

The description so far has centered around one portion of the device 10 of the present invention, namely the support base 12 and associated latching arm 20. As may be expected, when retaining two individual members in an adjacent condition, another member must be present and attach to the second of the two individual members for interaction with the support base 12 and its associated components. To that end, a receiver 30 is provided and is seen best in FIGS. 1 and 4. The receiver 30 is formed as a ring 32 with a circular cross section and a threaded shank 36 projecting outwardly from one side thereof for engagement with a second of the two individual members to be retained in an adjacent condition by the device 10 of the present invention. As seen in FIG. 4, the individual members 40,42 are illustrated as generally planar, nondescript members. Nevertheless, it will be understood by those skilled in the art that the individual members 40,42 can consist of a door and its associated door jamb, or a drawer and its associated frame. It will also be understood that some modification of the drawer frame may be warranted or the shank 36 may include a right angle to present the receiving member 32 in a proper disposition for being in registry with the support base 12 and a horizontally extending latching arm 20. It should be noted at this stage that there are several primary structural requirements to ensure compatibility of the receiver 30 with the support base 12 and its associated structure. Initially, it will be noted by those skilled in the art that the biasing member 24 need not be a sphere but may be triangular, pyramidal, square or any of a number of geometric configurations with the associated receiving member 32 being formed with an opening that accommodates or is complementary to the geometric structure of the biasing member 24. Illustrated in FIGS. 1–7, the biasing member 24 is a sphere of slightly smaller diameter than the diameter of the opening 34 associated with the receiving member 32. Additionally, it will be noted that the receiving member 32 need not be a complete circle but may be formed as a hook or any other configuration which may be blocked from movement by the latching arm 20. A further requirement of the receiver is that it accommodate the dimensions of the support base within the opening 34.

Figure 5:
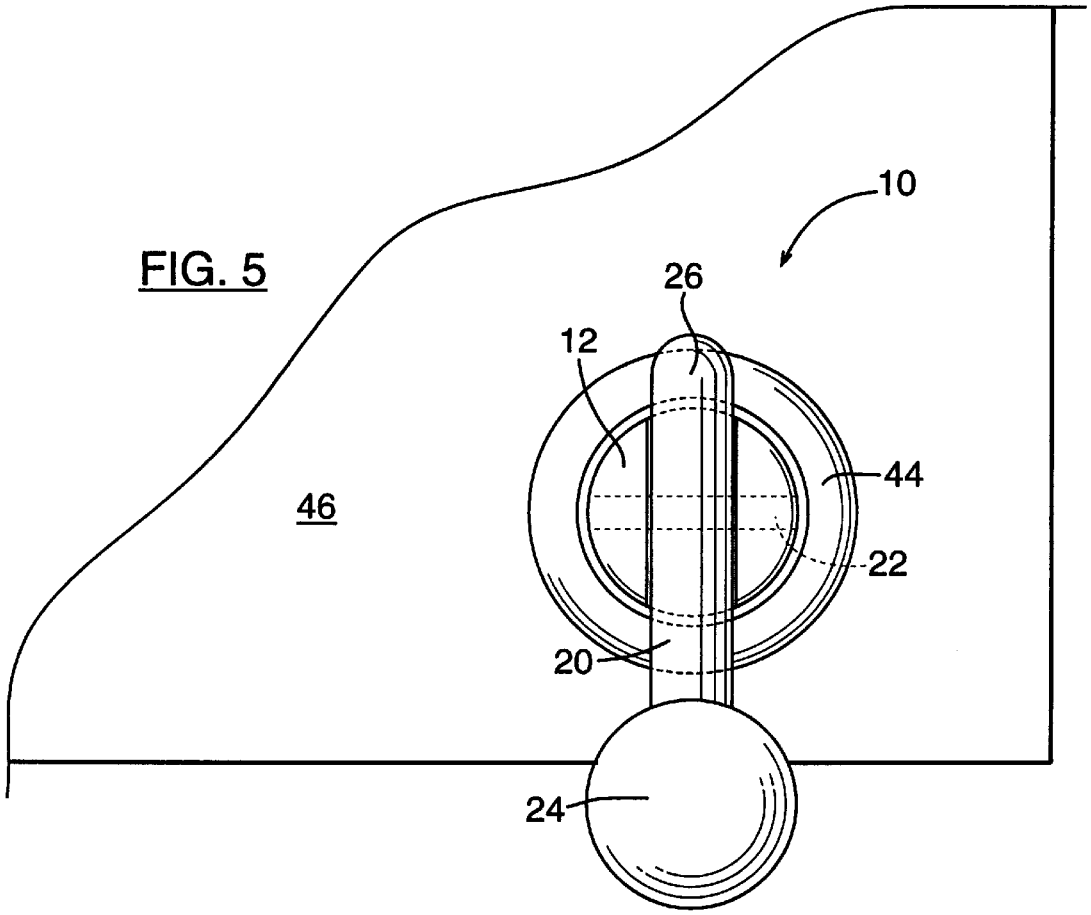
FIG. 5 is a front view of the device being utilized as a grommeted tarpaulin holder.

As seen in FIG. 5, the device 10 of the present invention may be used with a tarpaulin 46 which is fitted with a grommet 44 for retaining the tarpaulin against a support structure. It should be noted that, while a tarpaulin is discussed substantially in the present application, any flexible member having grommets for a hold-down arrangement, such as a tent, may be useful with the present invention. As seen in FIG. 5, the grommet 44 takes the place of the receiving member 32.

Figure 6:
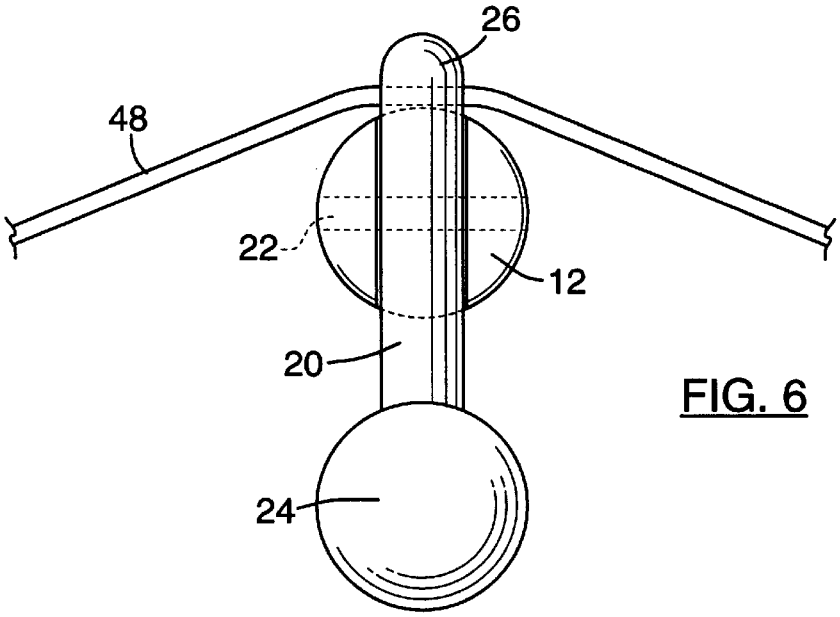
FIG. 6 is a front view of the device illustrated in FIG. 1 using a wire for a picture hanger.
Figure 7:
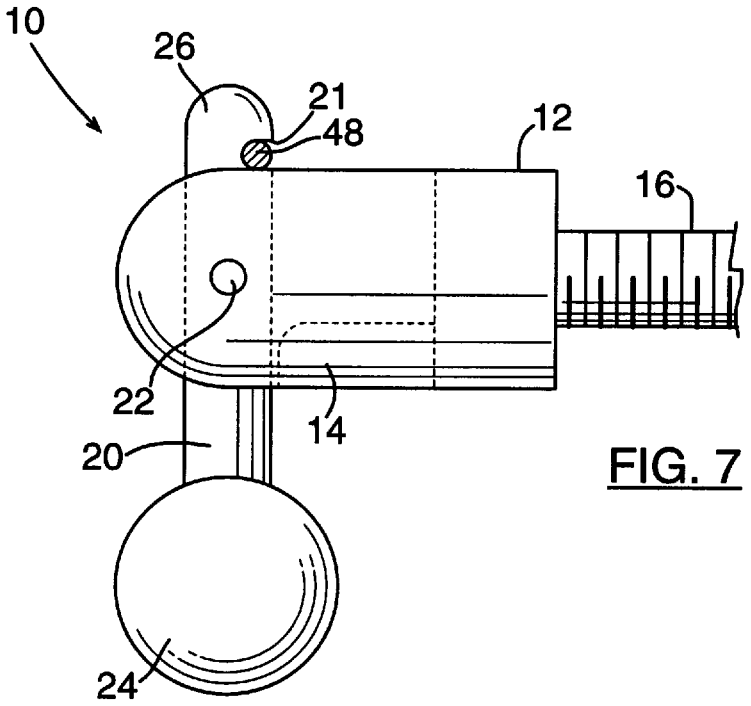
FIG. 7 is a side view of the device illustrated in FIG. 6.

Another structural modification of the present invention allows it to be used as a picture hanger, as seen in FIGS. 6 and 7. With reference to FIG. 7, a groove 21 is formed in the extended portion 26 of the latching arm 20 closely adjacent an upper surface of the support base 12 when the latching arm is in a vertical orientation. The groove accommodates a wire 48 which is attached to a picture frame in a known manner. As seen in FIG. 6, the wire 48 can form a receiving member by creating an opening below the wire through which the support base 12 may pass.

In operation, the support base 12 is fitted to one individual member for being retained in an adjacent condition with another individual member which has the receiver 30 attached thereto. A user engages the biasing member 24, moving it to a position where it is in generally horizontal alignment with the support base 12, projecting directly away therefrom. In this state, the latching arm 20 will be in abutment with the shoulder 14 as seen in FIG. 1. The second of the two individual members is brought into an adjacent condition with the first of the two individual members with the opening 34 associated with the receiving member 32 in registry with the biasing member 24 and the support base 12. As the individual members 40,42 are brought into an adjoining relation, the receiver 30 is fitted over the support base 12 in a surrounding relationship therewith to the extent that the pivot pin 22 is beyond the receiver 30.

Once the user releases the biasing member 24, gravity causes the biasing member 24 to seek the ground and results in the latching arm 20 attaining a vertically oriented disposition. This presents the upper extended portion 26 as well as the portion of the latching arm 20 extending below the support base 12 as a blocking agent for movement of the receiver 32 and, consequently, its associated individual member.

When releasing the two individual members from their adjacency the latching arm 20 is moved into a generally horizontal disposition as seen in FIG. 1 and the receiver 32 may be moved from its position around the support base 12. To that end, the tapered surface 28 on the upper extending portion 26 of the latching arm 20 acts to smoothly guide the latching arm 20 should it be abutted by the receiving member 32.

As may be expected, and with reference to FIG. 5, if the receiver 32 is a grommet or a tarpaulin or other flexible member, operation of the device is essentially the same.

If the device is used for a picture hanger, the support base 12 is affixed to a wall surface using the threaded shank 16 or a spike or even adhesive. The latching arm 20 is allowed to attain its naturally vertically oriented position and the picture frame hanging wire 48 is fitted into the groove 21 formed into the upper extending portion 26 of the latching arm 20 wherein it is retained in position. If the biasing member 24 was subjected to an attempt to move it to a horizontally oriented position, the wire 48 would prevent such movement and, therefore, the picture is retained in a very stable position when using the device 10 according to the present invention as a picture hanger.

By the above, it has been seen that the device for retaining two individual members in an adjacent condition is a very unique and simple device which is effective for many chores including drawer or door latching, tarpaulin hold-down duties and may also function as a picture hanger.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A device for retaining two individual members in an adjacent condition, comprising:

a support base attachable to a first of the two individual members;

a latching arm having a cross-sectional diameter and having two opposed ends and being pivotally mounted at a fixed location on said support base between said ends of said latching arm;

a biasing member having a cross-sectional diameter greater than said cross-sectional diameter of said latching arm and being attached to a said end of said latching arm for causing said latching arm to pivot downwardly under gravity's influence to a first vertical disposition; and a receiving member attachable to a second of the individual members and defining an opening through which said biasing member and part of said latching arm and said support base including said fixed location may be passed when said latching arm is not in said vertical disposition;

whereby when said biasing member causes said latching arm to pivot downwardly to said vertical disposition, said ends of said latching arm extend beyond opposite sides of said support base to retain said receiving member on said support base and thereby retain the two individual members in an adjacent condition.

2. A device for retaining two individual members in an adjacent condition according to claim 1 wherein said biasing member and said receiving member are formed with complimentary geometric cross-sectional configurations for passage of said biasing member through said defined opening.

3. A device for retaining two individual members in an adjacent condition according to claim 2 wherein said biasing member is formed as a sphere and said receiving member is formed as a ring.

4. A device for retaining two individual members in an adjacent condition according to claim 1 further comprising a threaded shank attached to said receiving member for attachment to the second of the individual members.

5. A device for retaining two individual members in an adjacent condition according to claim 1 wherein said latching arm is formed with a taper extending along a surface of said latching arm facing said receiving member when said device is in a latched condition for enhancing ease of latching arm movement should said latching arm abut said receiving member when moving said latching arm to a generally horizontal position for unlatching.

6. A device for retaining two individual members in an adjacent condition according to claim 1 further comprising a threaded member connected to said support base and projecting outwardly from said support base for attachment with the first of the two individual members.

7. A device for retaining two individual members in an adjacent condition according to claim 1 wherein said support base is formed as a generally cylindrical member having a slot formed therein for receipt of said latching arm, said latching arm being pivotally mounted to the support base in said slot.

8. A device for retaining two individual members in an adjacent condition according to claim 7 further including a pin extending through said support base and through said latching arm to define said fixed location for said pivotal mounting of said latching arm.

9. A device for retaining two individual members in an adjacent condition according to claim 7 wherein said support base includes a shoulder projecting into said slot for abutment of said latching arm thereagainst when said latching arm is extended outwardly from said support base in a generally horizontal manner.

10. A device for retaining two individual members in an adjacent condition according to claim 7 wherein said support base includes a shoulder projecting into said slot for abutment of said latching arm thereagainst when said latching arm is in said vertical disposition.

11. A device for retaining two individual members in an adjacent condition according to claim 10 wherein said shoulder further abuts said latching arm when said latching arm extends outwardly from said support base in a generally horizontal manner.

12. A device for retaining two individual members in an adjacent condition according to claim 10 wherein said support base includes a cross-sectional diameter that is greater than said cross-sectional diameter of said latching arm.

13. A device for retaining two individual members in an adjacent condition according to claim 1 wherein said support base includes a cross-sectional diameter that is greater than said cross-sectional diameter of said latching arm.

14. A device for retaining two individual members in an adjacent condition, comprising:

a support base having a shoulder and being attachable to a first of the two individual members;

a latching arm having two opposed ends and being pivotally mounted on said support base at a fixed location between said ends of said latching arm for pivoting between a first disposition and a second disposition, said ends of said latching arm extending beyond opposite sides of said support base when said latching arm is in said second disposition, said shoulder abutting said latching arm when in said second disposition thereby preventing further pivoting of said latching arm away from said first disposition; and a receiving member attachable to a second of the individual members and defining a sufficiently sized opening through which part of said latching arm and said support base including said fixed location may be passed when said latching arm is in said first disposition but not when said latching arm is in said second disposition, said latching arm when in said second vertical disposition thereby retaining said receiving member on said support base and retaining the two individual members in an adjacent condition.

15. A device according to claim 14 further comprising a biasing member attached to a said end of said latching arm for causing said latching arm to pivot to said second disposition due to the force of gravity.

16. A device according to claim 14 wherein said latching arm is formed with a taper extending along a surface of said latching arm facing said receiving member when said latching arm is in said second disposition for enhancing ease of pivoting said latching arm towards said first disposition should said latching arm abut said receiving member when in said second disposition.

17. A device according to claim 14 wherein said support base includes a slot formed therein for receipt of said latching arm, said latching arm being pivotally mounted to said support base in said slot.

18. A device for retaining two individual members in an adjacent condition, comprising:

an elongate support base having a cross-sectional diameter and being attachable to a first of the two individual members;

an elongate latching arm having a cross-sectional diameter less than said cross-sectional diameter of said support base and further having two opposed ends and being pivotally mounted on said support base at a fixed location between said ends of said latching arm for pivoting between a first disposition and a second disposition, said ends of said latching arm extending beyond opposite sides of said support base when said latching arm is in said second disposition; and a receiving member attachable to a second of the individual members and defining a sufficiently sized opening through which part of said latching arm and said support base including said fixed location may be passed when said latching arm is in said first disposition but not when said latching arm is in said second disposition, said latching arm when in said second disposition thereby retaining said receiving member on said support base and retaining the two individual members in an adjacent condition.

19. A device according to claim 18 further comprising a biasing member attached to a said end of said latching arm for causing said latching arm to pivot to said second disposition due to the force of gravity.

20. A device according to claim 18 wherein said latching arm is formed with a taper extending along a surface of said latching arm facing said receiving member when said latching arm is in said second disposition for enhancing ease of pivoting said latching arm towards said first disposition should said latching arm abut said receiving member when in said second disposition.

21. A device according to claim 18 wherein said support base includes a slot formed therein for receipt of said latching arm, said latching arm being pivotally mounted to said support base in said slot.

* * * * *